US009283609B2

(12) United States Patent
Huang

(10) Patent No.: US 9,283,609 B2
(45) Date of Patent: Mar. 15, 2016

(54) METAL FORMING SYSTEM WITH ACCELERATED MASS PRODUCTION

(71) Applicant: Chi-Jui Huang, New Taipei (TW)

(72) Inventor: Chi-Jui Huang, New Taipei (TW)

( * ) Notice: Subject to any disclaimer, the term of this patent is extended or adjusted under 35 U.S.C. 154(b) by 289 days.

(21) Appl. No.: 14/034,816

(22) Filed: Sep. 24, 2013

(65) Prior Publication Data

US 2014/0090439 A1 Apr. 3, 2014

(30) Foreign Application Priority Data

Sep. 28, 2012 (TW) ..... 101135690 A

(51) Int. Cl.

| | |
|---|---|
| ***B21D 26/02*** | (2011.01) |
| ***B21D 22/02*** | (2006.01) |
| ***B21D 22/12*** | (2006.01) |
| ***B21D 26/031*** | (2011.01) |
| ***B21D 9/08*** | (2006.01) |
| ***B21D 26/049*** | (2011.01) |
| ***B21D 26/025*** | (2011.01) |
| ***B21D 37/14*** | (2006.01) |
| ***B21D 43/13*** | (2006.01) |
| ***B30B 1/16*** | (2006.01) |
| ***B30B 1/18*** | (2006.01) |
| *B21D 37/16* | (2006.01) |

(52) U.S. Cl.

CPC *B21D 22/02* (2013.01); *B21D 9/08* (2013.01); *B21D 22/12* (2013.01); *B21D 26/025* (2013.01); *B21D 26/031* (2013.01); *B21D 26/049* (2013.01); *B21D 37/14* (2013.01); *B21D 43/13* (2013.01); *B30B 1/16* (2013.01); *B30B 1/18* (2013.01); *B21D 37/16* (2013.01)

(58) Field of Classification Search

CPC ..... B21D 9/08; B21D 22/12; B21D 26/031; B21D 26/049; B21D 37/14; B21D 37/16; B21D 43/13; B30B 1/16; B30B 1/18

USPC ..... 72/60

See application file for complete search history.

(56) References Cited

U.S. PATENT DOCUMENTS

| | | | | |
|---|---|---|---|---|
| 1,793,054 A * | 2/1931 | Carns | B21D 26/031 29/889 |
| 4,711,111 A * | 12/1987 | Hellgren | B21D 22/12 100/278 |
| 5,396,786 A * | 3/1995 | Bartholomew | B21D 9/08 29/421.1 |
| 6,354,125 B1 * | 3/2002 | Bernelf | B21D 26/02 72/448 |
| 6,553,804 B2 * | 4/2003 | Convert | B21D 37/14 100/301 |
| 7,568,369 B2 * | 8/2009 | Kubacki | B21D 26/049 425/525 |

* cited by examiner

*Primary Examiner* — David B Jones

(74) *Attorney, Agent, or Firm* — Rosenberg, Klein & Lee

(57) ABSTRACT

The present invention provides a metal forming system, comprising a platform and a gantry means, in which the platform is provided with a plurality of lower mold bases bearing sheet metals, while the gantry means is provided with at least one upper mold base and a toggle unit. The gantry means is performing lateral displacement on the platform, so as to be displaced to a location above the lower mold base which is predetermined to operate. The toggle unit is for adjusting the longitudinal position of the upper mold base so as to change the distance between the upper mold base and the lower mold base, resulting in determining whether a mold-closing state or a mold-opening state. A metal forming operation is performed on the sheet metal between the upper mold base and the lower mold base so as to manufacture a metal formed part when the mold-closing state.

10 Claims, 11 Drawing Sheets

METAL FORMING SYSTEM WITH ACCELERATED MASS PRODUCTION

FIELD OF THE INVENTION

The present invention provides a metal forming system with accelerated mass production, particularly to a metal forming system allowed for pressure forming with respect to sheet metal.

BACKGROUND

As technology advances and develops, the more and more personalized and elaborate design is required by current customers for electronic products, such as mobile phones or notebooks, for example. The appearance and shape of metal shells of these electronic products is often one major cause of affecting the aspiration to purchase of the customers.

Referring to FIG. 1, there is shown a structural diagram illustrating a conventional metal forming process. As illustrated in FIG. 1(A), firstly, a material feeding unit 101 is allowed to provide a sheet metal 11 to be formed to the top surface of a forming mold 13.

As illustrated in FIG. 1(B), the forming mold 13 and the sheet metal 11 are moved to the top end of an oil hydraulic press 17 via a material moving unit 102. On the vertical extension above the oil hydraulic press 17, there is fixedly provided a sealing mold 15. With the moving up and down of the oil hydraulic press 17, the distance between the forming mold 13 and the sealing mold 15 may be changed, so as to further form either a mold-opening state or a mold-closing state.

As illustrated in FIG. 1(C), a forming procedure is performed with respect to the sheet metal 11. The oil hydraulic press 17 is driven up, in such a way that the mold-closing state is presented between the forming mold 13 and the sealing mold 15. After that, heaters 131/151 surroundingly provided around the periphery of the forming mold 13 and the sealing mold 15, respectively, may be allowed to perform high-temperature heating, such that the forming mold 13, the sealing mold 15 as well as the sheet metal 11 disposed between the forming mold 13 and the sealing mold 15 may be heated to a predetermined forming temperature. Subsequently, a high-pressure fluid 180 is provided by a fluid supplier 18. This high-pressure fluid 180 may be injected into a chamber of the sealing mold 15 through at least one fluid passage 181 provided in the sealing mold 15, so as to apply fluid pressure to the sheet metal 11 between the forming mold 13 and the sealing mold 15, in such a way that the sheet metal 11 may be adhered to an inner surface of the forming mold 13, under the action of fluid pressure, thus formed into a metal formed part 110. After the metal formed part 110 is completed, heating of the heaters 131/151 is stopped, as well as the forming mold 13, the sealing mold 15 and the metal formed part 110 are then cooled in atmospheric environment. After a cooling period, the oil hydraulic press 17 is driven down to achieve the mold-opening state between the forming mold 13 and the sealing mold 15. Afterwards, the forming mold 13 and the metal formed part 110 arranged at the top end of the oil hydraulic press 17 may be removed, and then, another forming mold 13 and another sheet metal 11 to be formed may be laid by means of the material moving unit 102 to proceed another forming operation on the sheet metal 11.

In this case, different from the procedure of prior metal forming configuration, a metal forming system of novel design is additionally provided by the present invention, in which not only the successful manufacturing of metal formed parts, but also further reduced manufacturing lead time of an individual metal formed part, may be the objects to be achieved by the present invention desirably.

SUMMARY OF THE INVENTION

It is one object of the present invention to provide a metal forming system with accelerated mass production, comprising a gantry means provided with an upper mold base and a platform provided with a plurality of lower mold bases bearing sheet metals, allowing the gantry means to displace laterally over the platform to a location above one of the lower mold bases predetermined to operate. Afterwards, the longitudinal position of the upper mold base is adjusted by the gantry means to determine whether a mold-closing or mold-opening state is presented between the upper mold base and the lower mold base. A metal forming operation is performed on a sheet metal between the upper mold base and the lower mold base so as to manufacture a metal formed part when the mold-closing state is presented between the upper mold base and the lower mold base.

It is one object of the present invention to provide a metal forming system with accelerated mass production, in which a part of surface of the upper mold base is painted with an anti-sticking coating having an anti-sticking effect, by which the metal formed part in high-temperature state may be not stuck to the upper mold base, in such a way that the upper mold base may be then opened with respect to the lower mold base immediately without the need to wait a cooling process. Thereby, the manufactured metal formed part may be demolded from the upper mold base rapidly, leading to an effectively reduced manufacturing lead time of one individual metal formed part.

It is one object of the present invention to provide a metal forming system with accelerated mass production, in which the upper mold base provided on the gantry means is a forming mold, the sheet metal being formed in the upper mold base.

It is one object of the present invention to provide a metal forming system with accelerated mass production, in which the longitudinal position of the upper mold base is adjusted by the gantry means via two mold locking means, so as to enhance the effect of mold locking between the upper mold base and the lower mold base.

To achieve above objects, the present invention provides a metal forming system with accelerated mass production, comprising: a platform provided at each of both sides thereof with a laterally displacing unit, respectively; a gantry means, mounted above the platform, comprising at least two uprights and a top base, the top base being provided on the top end of each of the uprights, while the bottom end of each of the uprights being fixed on the corresponding laterally displacing unit, respectively, the gantry means capable of being driven by the laterally displacing unit to perform lateral displacement on the platform; a plurality of lower mold bases provided at the center of the platform; at least one upper mold base, a sheet metal being provided between the upper mold base and each of the lower mold bases; and a toggle unit, provided between the top base of the gantry means and the upper mold base, used for adjusting the longitudinal position of the upper mold base so as to change the distance between the upper mold base and the lower mold base, resulting in determining whether a mold-closing state or a mold-opening state is formed between the upper mold base and the lower mold base, a metal forming operation being performed on the sheet metal between the upper mold base and the lower mold base so as to manufacture a metal formed part when the mold-closing state is presented between the upper mold base and the lower mold base.

In one embodiment of the present invention, wherein the toggle unit comprises a first link, a second link and a pneumatic cylinder, one end of the first link is pivoted on a bottom surface of the top base, while one end of the second link is pivoted on a top surface of the upper mold base, the other end of the first link is pivoted to that of the second link together to form a pivot, the pneumatic cylinder being connected to the pivot so as to drive the toggle unit to generate toggle motion, resulting in the adjustment of longitudinal position of the upper mold base.

In one embodiment of the present invention, wherein each of the two uprights is individually provided at inner side thereof with a longitudinally displacing unit, a movable board being further provided between the toggle unit and the upper mold base, the longitudinally displacing unit comprising a screw rod and a driving part, the movable board being provided at each of two sides thereof with a threaded hole, respectively, each threaded hole being allowed to wrap around the corresponding screw rod, respectively, the driving part driving the screw rod to turn so as to drive the movable board to move up and down, thus further adjusting the longitudinal position of the upper mold base.

In one embodiment of the present invention, wherein the upper mold base comprises an inner surface and at least one joint face to be joined to the sheet metal, an anti-sticking coating being provided on the inner surface and/or the joint face of the upper mold base.

In one embodiment of the present invention, wherein the lower mold base is provided on an inner surface thereof with a pattern layer.

In one embodiment of the present invention, wherein the upper mold base is a sealing mold, while the lower mold base is a forming mold, the upper mold base being provided with a fluid passage, a high-pressure fluid provided by a fluid supplier is injected into an inner chamber of the upper mold base through the fluid passage of the upper mold base, in such a way that the sheet metal is adhered to an inner surface of the lower mold base under the action of fluid pressure of the high-pressure fluid, thus manufacturing the metal formed part.

In one embodiment of the present invention, wherein the upper mold base is provided on an inner surface thereof with a pattern layer.

In one embodiment of the present invention, wherein the upper mold base is a forming mold, while the lower mold base is a sealing mold, the lower mold base being provided with a fluid passage, a high-pressure fluid provided by a fluid supplier is injected into an inner chamber of the lower mold base through the fluid passage of the upper mold base, in such a way that the sheet metal is adhered to an inner surface of the upper mold base under the action of fluid pressure of the high-pressure fluid, thus manufacturing the metal formed part.

The present invention further provides a metal forming system with accelerated mass production, comprising: a platform provided at each of both sides thereof with a laterally displacing unit, respectively; a gantry means, mounted above the platform, comprising at least two uprights and a top base, the top base being provided on the top end of each of the uprights, while the bottom end of each of the uprights being fixed on the corresponding laterally displacing unit, respectively, the gantry means capable of being driven by the laterally displacing unit to perform lateral displacement on the platform; a pair of longitudinally displacing units, each provided at inner side of corresponding one of the uprights, respectively; a plurality of lower mold bases provided at the center of the platform; and at least one upper mold base, a sheet metal being provided between the upper mold base and each of the lower mold bases, the upper mold base being mounted to the longitudinally displacing units via a movable board, the longitudinally displacing units being used for adjusting the longitudinal position of the upper mold base so as to change the distance between the upper mold base and the lower mold base, resulting in determining whether a mold-closing state or a mold-opening state is formed between the upper mold base and the lower mold base, a metal forming operation being performed on the sheet metal between the upper mold base and the lower mold base so as to manufacture a metal formed part when the mold-closing state is presented between the upper mold base and the lower mold base.

In one embodiment of the present invention, wherein the longitudinally displacing unit comprises a screw rod and a driving part, the movable board being provided at each of two sides thereof with a threaded hole, respectively, each threaded hole being allowed to wrap around the screw rod, the driving part driving the screw rod to turn so as to drive the movable board to move up and down, thus further adjusting the longitudinal position of the upper mold base.

DETAILED DESCRIPTION

Figure 1:
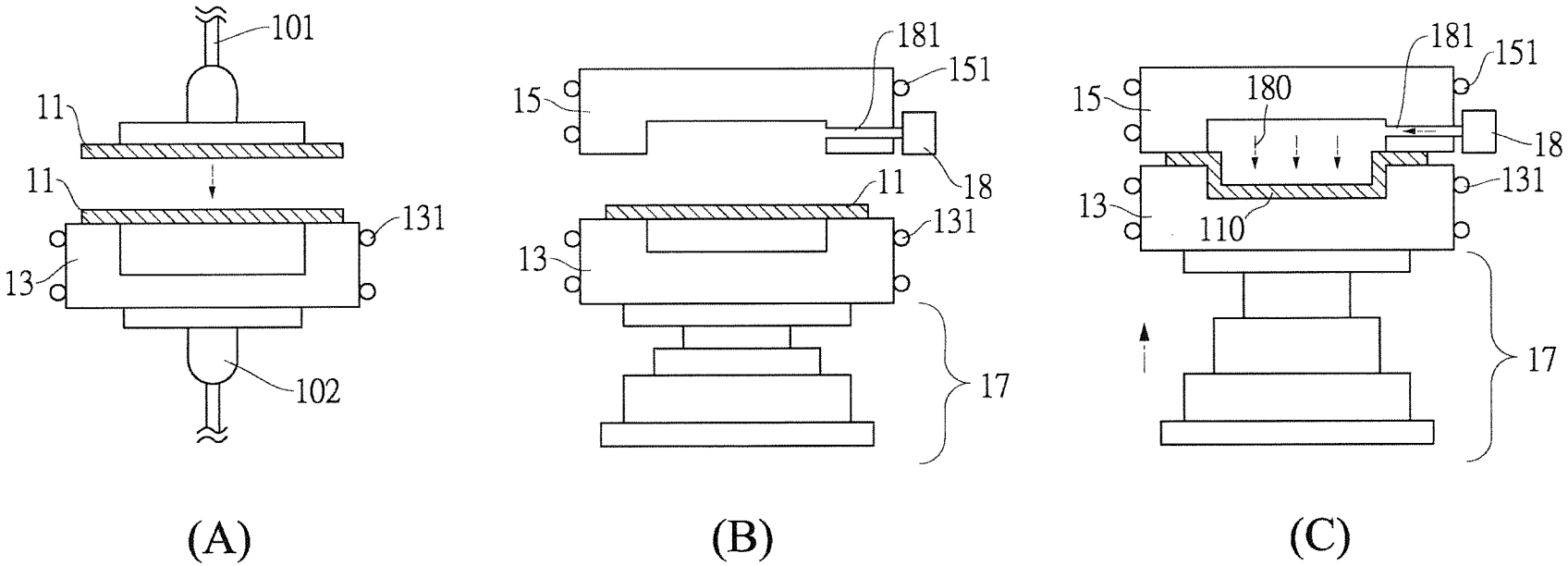
FIG. 1 is a structural diagram illustrating a conventional metal forming process.
Figure 2:
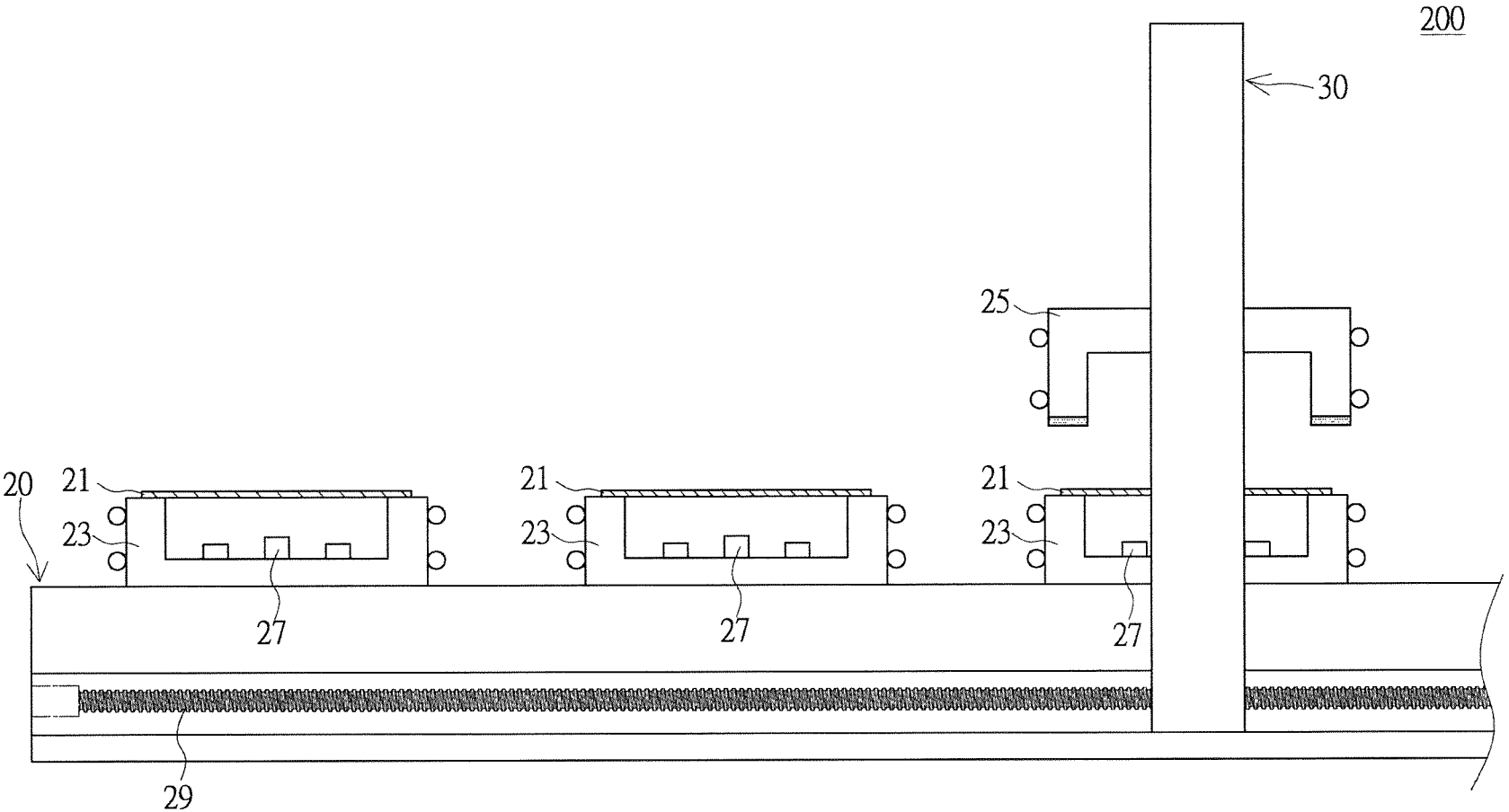
FIG. 2 is a schematic side view of a metal forming system with accelerated mass production according to one preferred embodiment of the present invention.
Figure 3:
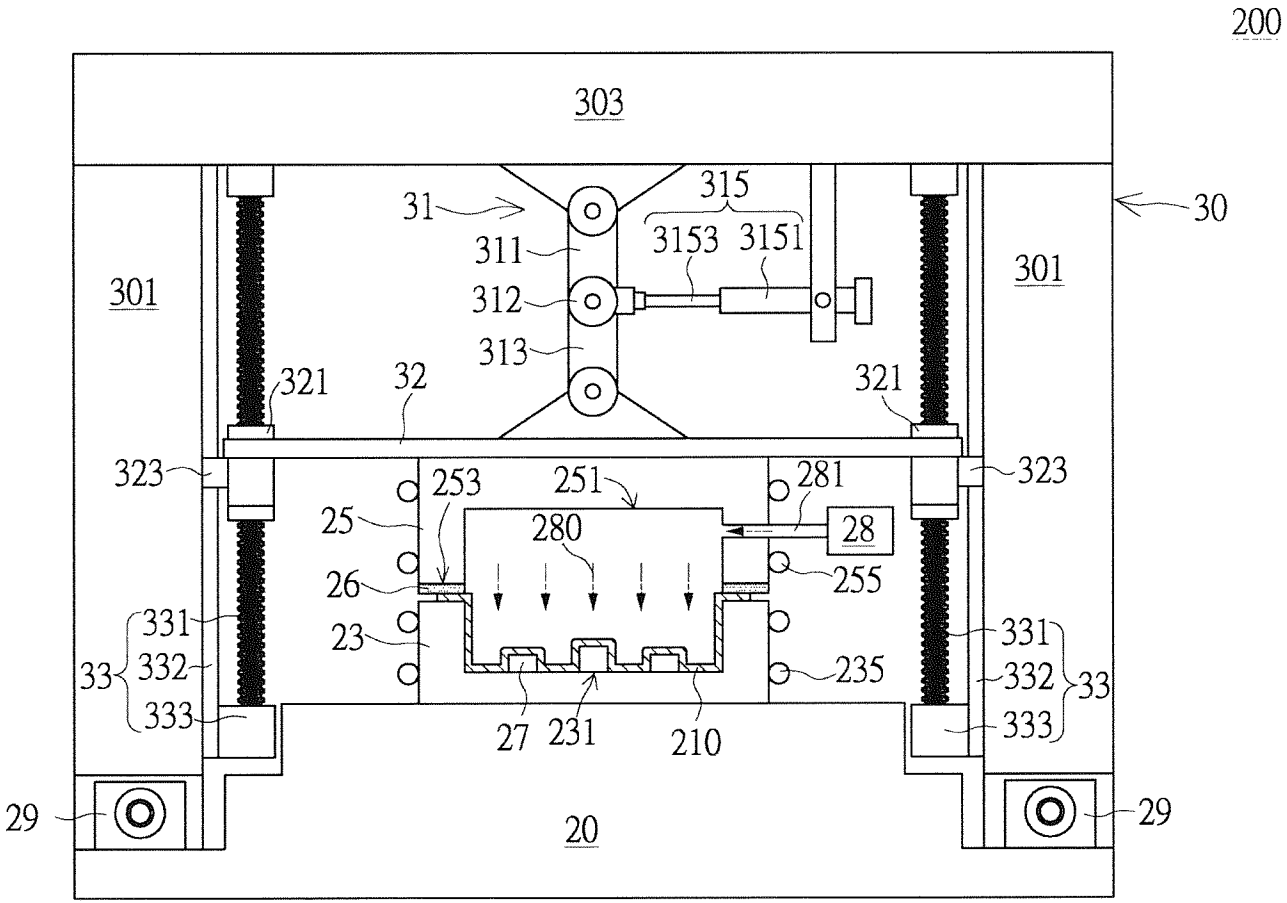
FIG. 3 is a schematic front view illustrating a mold-closing state formed between the upper mold base and the lower mold base of the metal forming system with accelerated mass production according to the preferred embodiment of the present invention.
Figure 4:
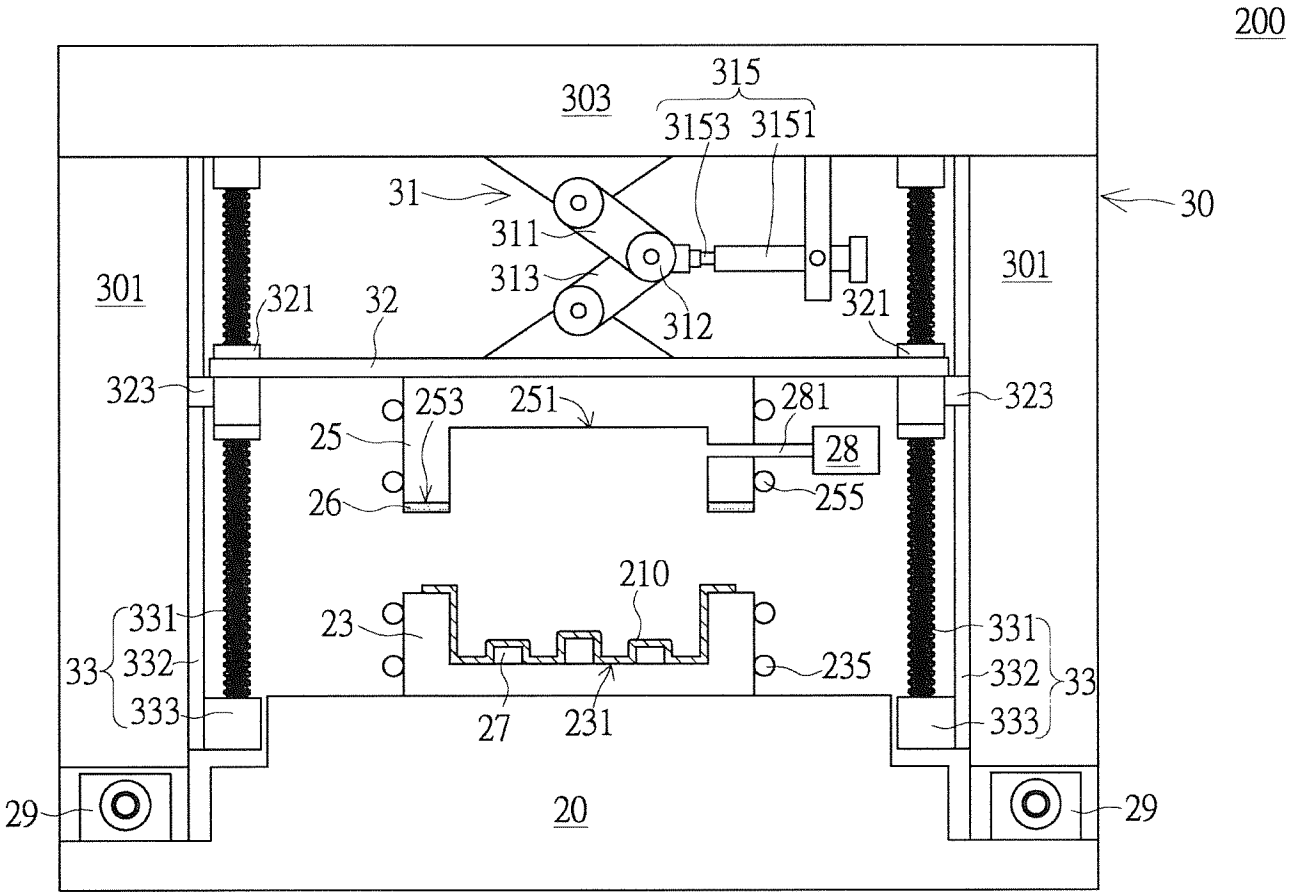
FIG. 4 is a schematic front view illustrating a mold-opening state formed between the upper mold base and the lower mold base of the metal forming system with accelerated mass production according to the preferred embodiment of the present invention.

Referring to FIGS. 2, 3 and 4, there are shown a schematic side view of a metal forming system with accelerated mass production according to one preferred embodiment a schematic front view illustrating a mold-closing state formed between the upper mold base and the lower mold base of the metal forming system according to the preferred embodiment, as well as a schematic front view illustrating a mold-opening state formed between the upper mold base and the lower mold base of the metal forming system according to the preferred embodiment of the present invention, respectively. As illustrated in the figures, a metal forming system 200 of the present invention is a gantry of metal forming system, the main structure thereof comprising a platform 20 and a gantry means 30.

The platform 20 is provided at the center thereof with a plurality of lower mold bases 23, on each of which a sheet metal 21 is laid, respectively. At each of both sides of the platform 20, a laterally displacing unit 29 is provided, respectively. In this embodiment, the laterally displacing unit 29 may be the combination of a ball screw means and a slide rail means.

The gantry means 30 comprises at least two uprights 301 and a top base 303. The top base 303 is provided on the top end of two uprights 301 so as to form a gantry structure, while at least one upper mold base 25 is mounted below the top base 303. The bottom end of each of the uprights 301 is fixed on the corresponding laterally displacing unit 29, respectively. The gantry means 30 is capable of being driven by the laterally displacing unit 29 to perform lateral displacement on the platform 20, in such a way that the gantry means 30 may be displaced to a location above one lower mold base 23 which is predetermined to operate.

In this embodiment, the upper mold base 25 is a sealing mold provided therein with a chamber, while the lower mold base 23 is a forming mold provided therein with another chamber. The body of the upper mold base 25 is further provided with a fluid passage 281, which may be connected to a fluid supplier 28. Furthermore, at least one heater 255/235 is around the periphery of the upper mold base 25 and/or the lower mold base 23. The heater 255/235 is used for heating at high temperature with respect to the upper mold base 25 and/or the lower mold base 23. Moreover, the sheet metal 21 laid on each lower mold base 23 or the sheet metal 21 pressed between the upper mold base 25 and the lower mold base 23 may be heated indirectly via heating of the upper mold base 25 and/or the lower mold base 23, such that the sheet metal 21 may be then softened by heating.

Between the top base 303 of the gantry means 30 and the upper mold base 25, there is further provided with a toggle unit 31, which is used as a mold locking means. The upper mold base 25 is mounted below the top base 303 via the toggle unit 31. The toggle unit 31 is used to adjust the longitudinal position of the upper mold base 25, so as to change the distance between the upper mold base 25 and the lower mold base 23, further determining whether a mold-closing state (as illustrated in FIG. 3) or a mold-opening state (as illustrated in FIG. 4) is formed between the upper mold base 25 and the lower mold base 23.

The toggle unit 31 comprises a first link 311, a second link 313 and a pneumatic cylinder 315. One end of the first link 311 is pivoted on the bottom surface of the top base 303, while one end of the second link 313 is pivoted on the top surface of the upper mold base 25. The other end of the first link 311 is pivoted to that of the second link 313 together to form a pivot 312. The pneumatic cylinder 315 comprises a fixing part 3151 fixed to the bottom surface of the top base 303, and an extensible part 3153 pivoted to the pivot 312.

As illustrated in FIG. 3, when the pneumatic cylinder 315 is operated, the extensible part 3153 of the pneumatic cylinder 315 may be extended with respect to the fixing part 3151, so as to drive the toggle unit 31 to generate the toggle motion, in such a way that straight linkage between the first link 311 and the second link 313 is presented gradually. At this time, the upper mold base 25 may be driven by the toggle unit 31 downward and toward the lower mold base 23 to approach thereto, such that the mold-closing state may be formed between the upper mold base 25 and the lower mold base 23. After the mold-closing state is formed between the upper mold base 25 and the lower mold base 23, a high-pressure fluid 280 may be provided by the fluid supplier 28, and then injected into the inner chamber of the upper mold base 25 through the fluid passage 281. The high-pressure fluid 280 is allowed to apply fluid pressure to the sheet metal 21 having been softened by heating, in such a way that the sheet metal 21 is adhered to an inner surface 231 of the lower mold base 23 under the action of fluid pressure to be formed into a metal formed part 210 accordingly. Furthermore, the high-pressure fluid 280 mentioned in the present invention is air, at least one liquid, at least one inert gas, or the mixture thereof, in which inert gas is preferred. Helium (He), neon (Ne), nitrogen ($N_2$) or the like may be selected if inert gas is used as the high-pressure fluid 280.

Subsequently, as illustrated in FIG. 4, the pneumatic cylinder 315 is operated again after the metal formed part 210 is completed, in which the extensible part 3153 of the pneumatic cylinder 315 may be shrunk with respect to the fixing part 3151, so as to drive the toggle unit 31 to generate the toggle motion, in such a way that a zigzag between the first link 311 and the second link 313 is presented gradually. At this time, the upper mold base 25 may be driven by the toggle unit 31 upward and separately from the lower mold base 23, such that the mold-opening state may be formed between the upper mold base 25 and the lower mold base 23. After the mold-opening state is formed between the upper mold base 25 and the lower mold base 23, the gantry means 30 is driven by the laterally displacing unit 29 again to perform displacement toward a location above another lower mold base 23 which is predetermined to operate next. Then, the metal forming operation is proceeded on the next sheet metal 21.

Further, in one preferred embodiment of the present invention, the upper mold base 25 comprises at least one joint face 253 capable of being joined to the sheet metal 21. Moreover, the joint face 253 is provided thereon with a heat-resistant anti-sticking coating 26, which may be made of chromium or Teflon. In the former metal forming operation, it is necessary for the upper mold base 25 to wait a cooling process before this upper mold base 25 is allowed to open with respect to the lower mold base 23, after the metal formed part 210 is manufactured at high temperature. Otherwise, it is incapable of demolding successfully due to the fact that the metal formed part 210 having been soften by heating may be stuck to surface pores of the joint face 253 of the upper mold base 25.

The surface pores of the joint face 253 may be filled to avoid being stuck by the metal formed part 210 in high-temperature state, by means of painting the anti-sticking coating 26 to the joint face 253 of the upper mold base 25. Then, the upper mold base 25 may be opened with respect to the lower mold base 23 immediately without the need to wait a cooling process, in such a way that the metal formed part 210 may be demolded from the upper mold base 25 rapidly. As such, not only the lower mold base 23 and the metal formed part 210 borne thereon may be driven away from the platform 20 rapidly to be successively subject to subsequent temper in the last stage of production, but also the upper mold base 25 may be displaced rapidly via the gantry means 30 to a location above the next lower mold base 23 so as to proceed metal forming operation on next sheet metal 21, facilitating effective reduction in manufacturing lead time of each metal formed part 210. In addition, the upper mold base 25 and each lower mold base 23 are heated by the heaters 255/235 all the time to be kept at high temperature during manufacturing, because the upper mold base 25 is allowed to open with respect to the lower mold base 23 without the need to wait a cooling process.

Further, each of the two uprights 301 of the gantry means 30 of the present invention is individually provided at inner side thereof with a longitudinally displacing unit 33, which is another mold locking means. The longitudinally displacing unit 33 may be also, similar to the toggle unit 31, used for the adjustment of longitudinal position of the upper mold base 25. Furthermore, there is further provided with a movable board 32 between the toggle unit 31 and the upper mold base 25, in which the upper mold base 25 is mounted to the longitudinally displacing unit 33 via the movable board 32. The longitudinally displacing unit 33 comprises a screw rod 331 and a driving part 333, while the movable board 32 is provided at each of two sides thereof with a threaded hole 321, respectively. Each threaded hole 321 is allowed to wrap around the corresponding screw rod 331, respectively. In addition, a slide rail 332 is between the upright 301 and the screw rod 331, while a slide base 323 is connected to the side of the threaded hole 321. The slide base 323 may slide on the slide rail 332.

Referring to FIG. 3 again, when the extensible part 3153 of the pneumatic cylinder 315 of the toggle unit 31 is extended with respect to the fixing part 3151, such that the first link 311 and the second link 313 are moved in toggle motion to present straight linkage, the screw rod 331 may be also driven by the driving part 333 of the longitudinally displacing unit 33 simultaneously to turn in the clockwise direction, for example. When the screw rod 331 is turned in the clockwise direction, the slide base 323 of the movable board 32 may be driven to displace downward along the slide rail 332, and the upper mold base 25 is then allowed to approach to the lower mold base 23 to form the mold-closing state with respect to the lower mold base 23.

Referring to FIG. 4, on the contrary, when the extensible part 3153 of the pneumatic cylinder 315 of the toggle unit 31 is shrunk with respect to the fixing part 3151, such that the first link 311 and the second link 313 are moved in toggle motion to present a zigzag, the screw rod 331 may be also driven by the driving part 333 of the longitudinally displacing unit 33 simultaneously to turn in the counterclockwise direction, for example. When the screw rod 331 is turned in the counterclockwise direction, the slide base 323 of the movable board 32 may be driven to displace upward along the slide rail 332, and the upper mold base 25 is then separated from the lower mold base 23 to form the mold-opening state with respect to the lower mold base 23.

The longitudinally displacing unit 33 is provided for not only facilitating the toggle unit 31 to adjust the longitudinal position of the upper mold base 25 more precisely, but also enhancing the more firm mold-locking effect between the upper mold base 25 and the lower mold base 23, so as to avoid leakage of the high-pressure fluid 280 from the gap between the upper mold base 25 and the lower mold base 23 during the metal forming operation on the sheet metal 21, and thus, the effect on manufacturing quality of the metal formed part 210.

In the present embodiment, the lower mold base 23 is further provided on the inner surface 231 thereof with a pattern layer 27. The pattern layer 27 is presented as configuration including patterns, lines, bright surface, matte surface, characters and/or other representations. After the sheet metal 21 is heated and applied with high pressure, the sheet metal 21 may be pressed against the pattern layer 27 to be formed. Thus, after pressure forming and demolding, the metal formed part 210 is then carved to form the patterns, lines, bright surface, matte surface, characters or other representations on the outer surface thereof.

Figure 5:
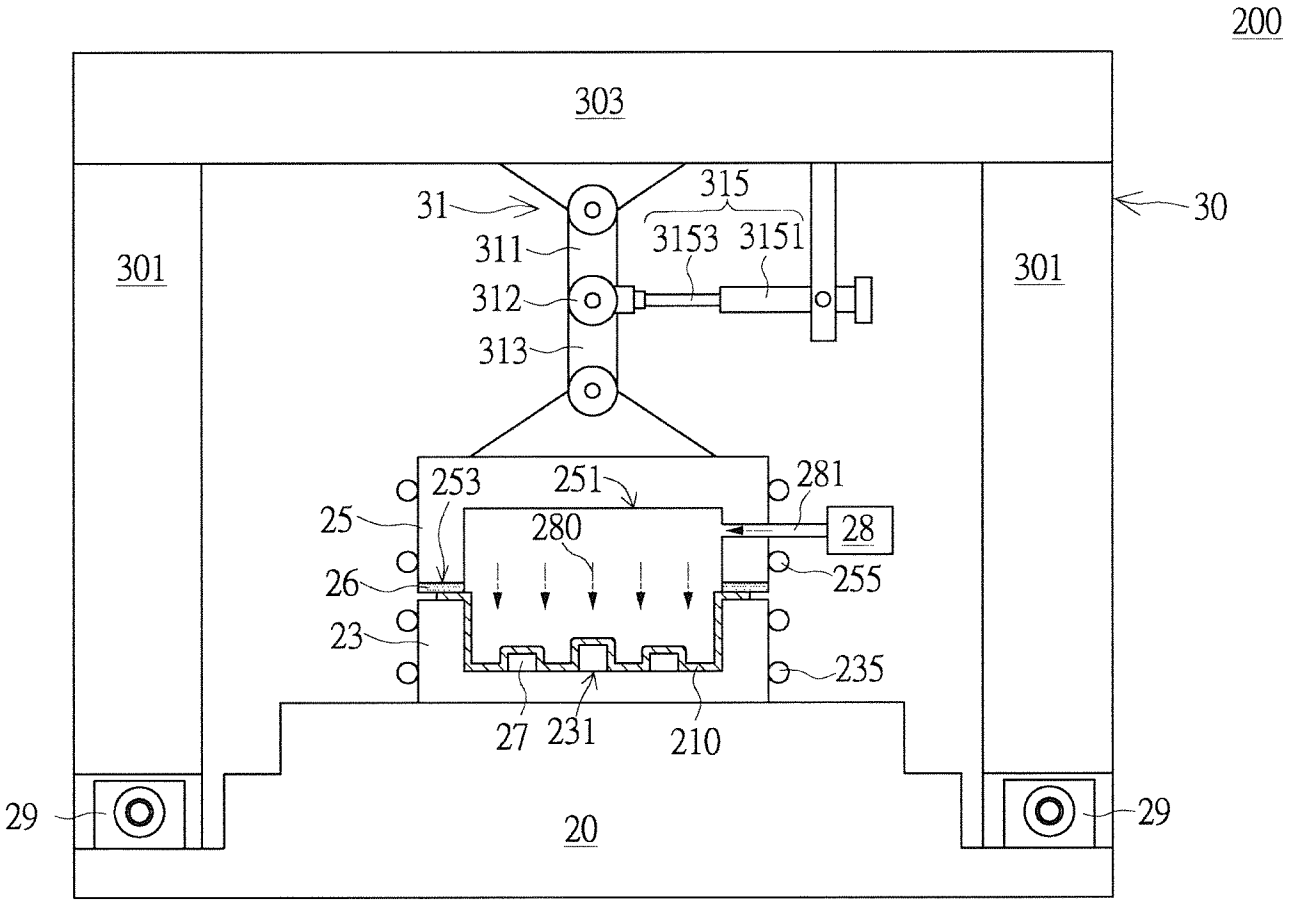
FIG. 5 is a schematic front view illustrating a mold-closing state formed between the upper mold base and the lower mold base of the metal forming system with accelerated mass production according to another embodiment of the present invention.
Figure 6:
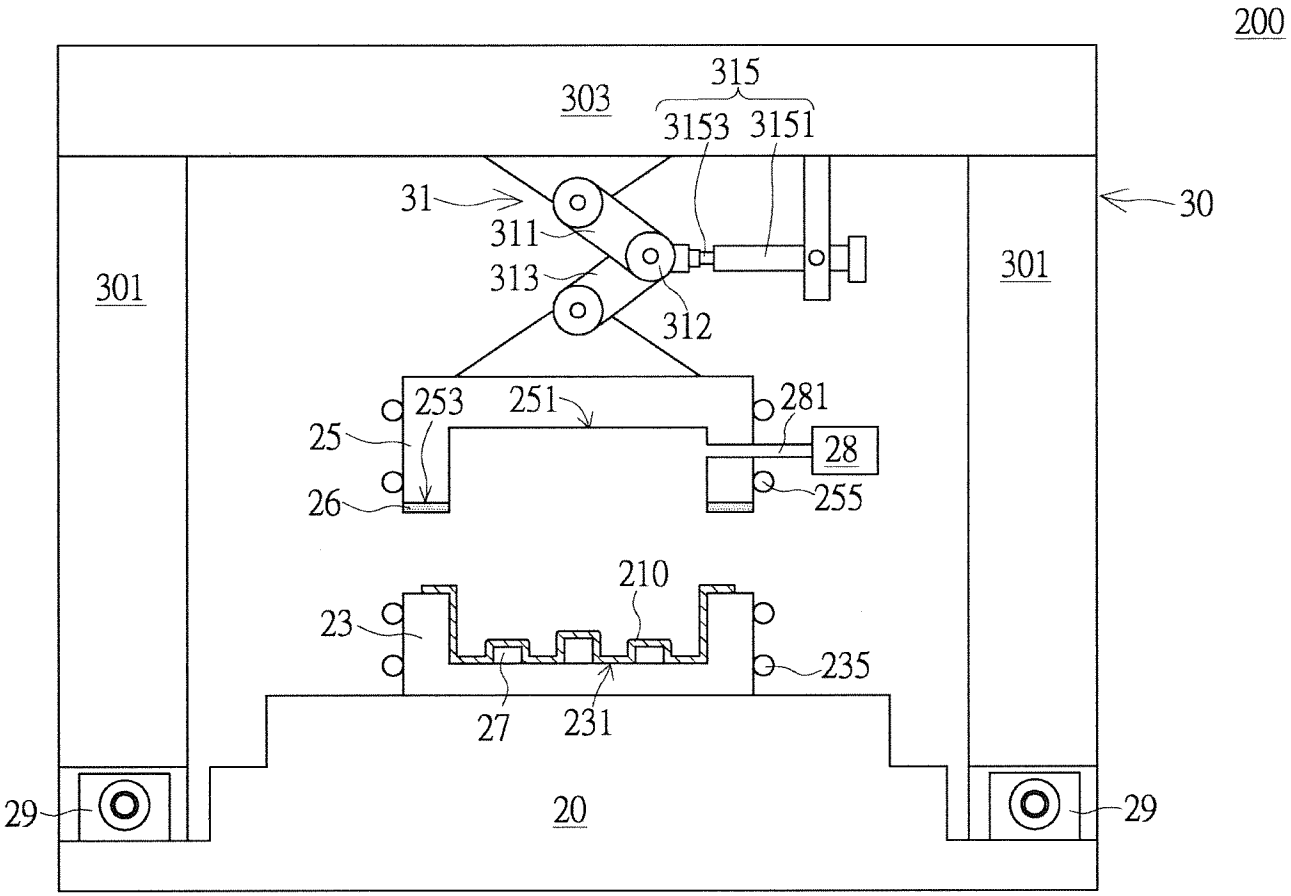
FIG. 6 is a schematic front view illustrating a mold-opening state formed between the upper mold base and the lower mold base of the metal forming system with accelerated mass production according to another embodiment of the present invention.
Figure 7:
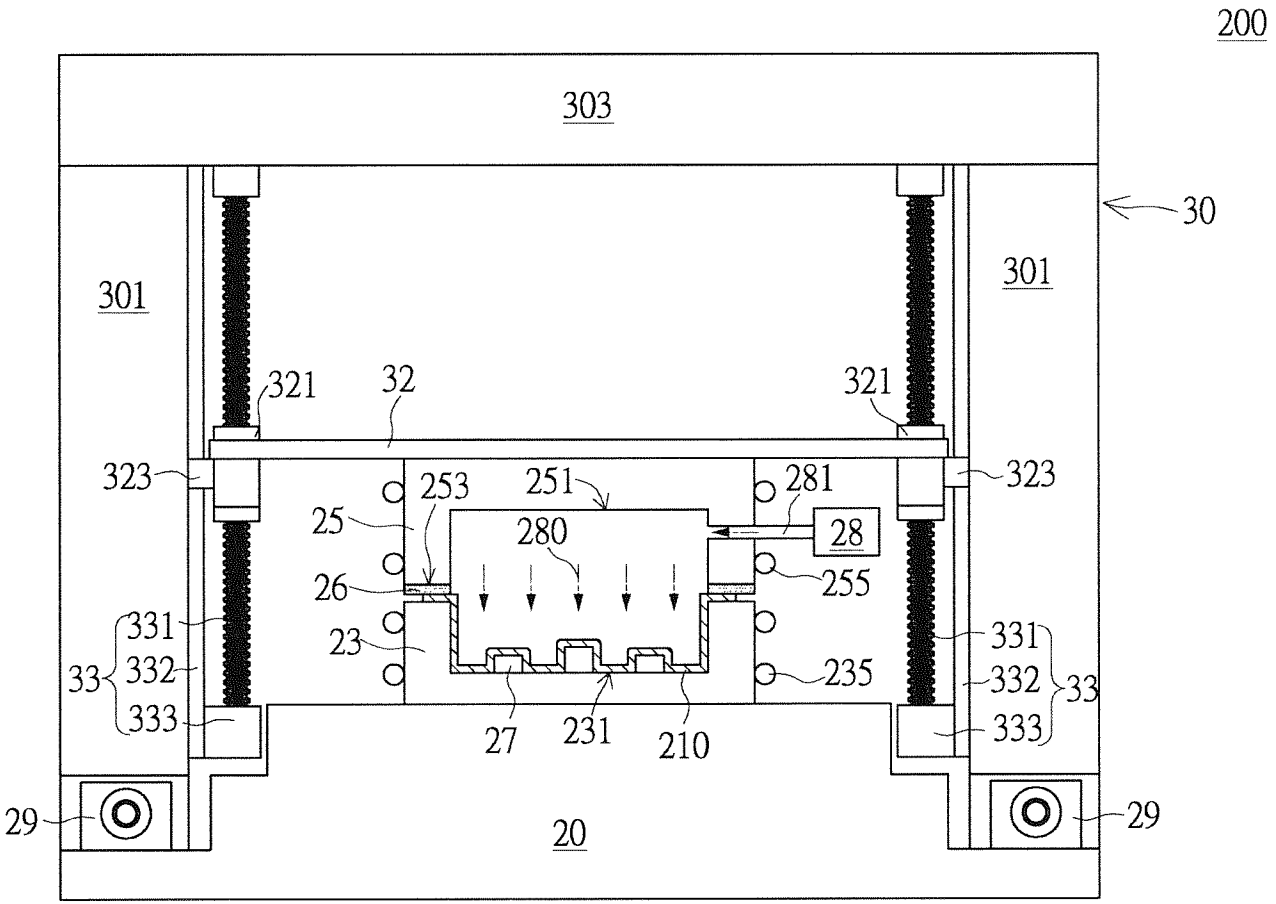
FIG. 7 is a schematic front view illustrating a mold-closing state formed between the upper mold base and the lower mold base of the metal forming system with accelerated mass production according to further embodiment of the present invention.
Figure 8:
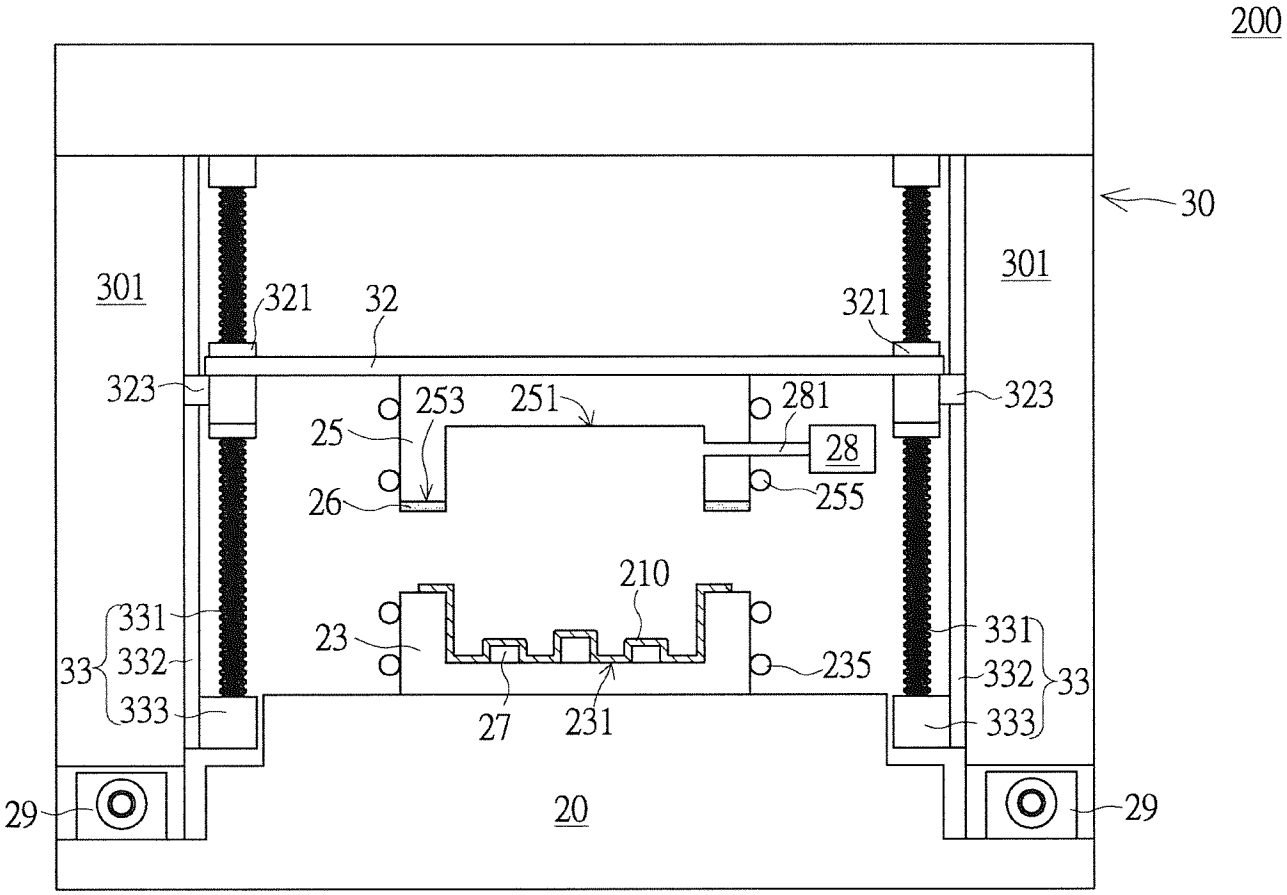
FIG. 8 is a schematic front view illustrating a mold-opening state formed between the upper mold base and the lower mold base of the metal forming system with accelerated mass production according to further embodiment of the present invention.

As mentioned above, two mold-locking means (such as toggle unit 31 and longitudinally displacing unit 33, for example) are used in the metal forming system 200 of the present invention to adjust the longitudinal position of the upper mold base 25. As illustrated in FIGS. 5 and 6, however, only one single mold-locking means (such as toggle unit 31, for example) may be also selectively established in another embodiment of the present invention to adjust the longitudinal position of the upper mold base 25 without the movable board 32 provided between the upper mold base 25 and the toggle unit 31. Alternatively, as illustrated in FIGS. 7 and 8, only another mold-locking means (such as longitudinally displacing unit 33, for example) may be also selectively established in further embodiment of the present invention to adjust the longitudinal position of the upper mold base 25 without any connecting component (such as toggle unit 31, for example) provided between the upper mold base 25 and the top base 303.

Figure 9:
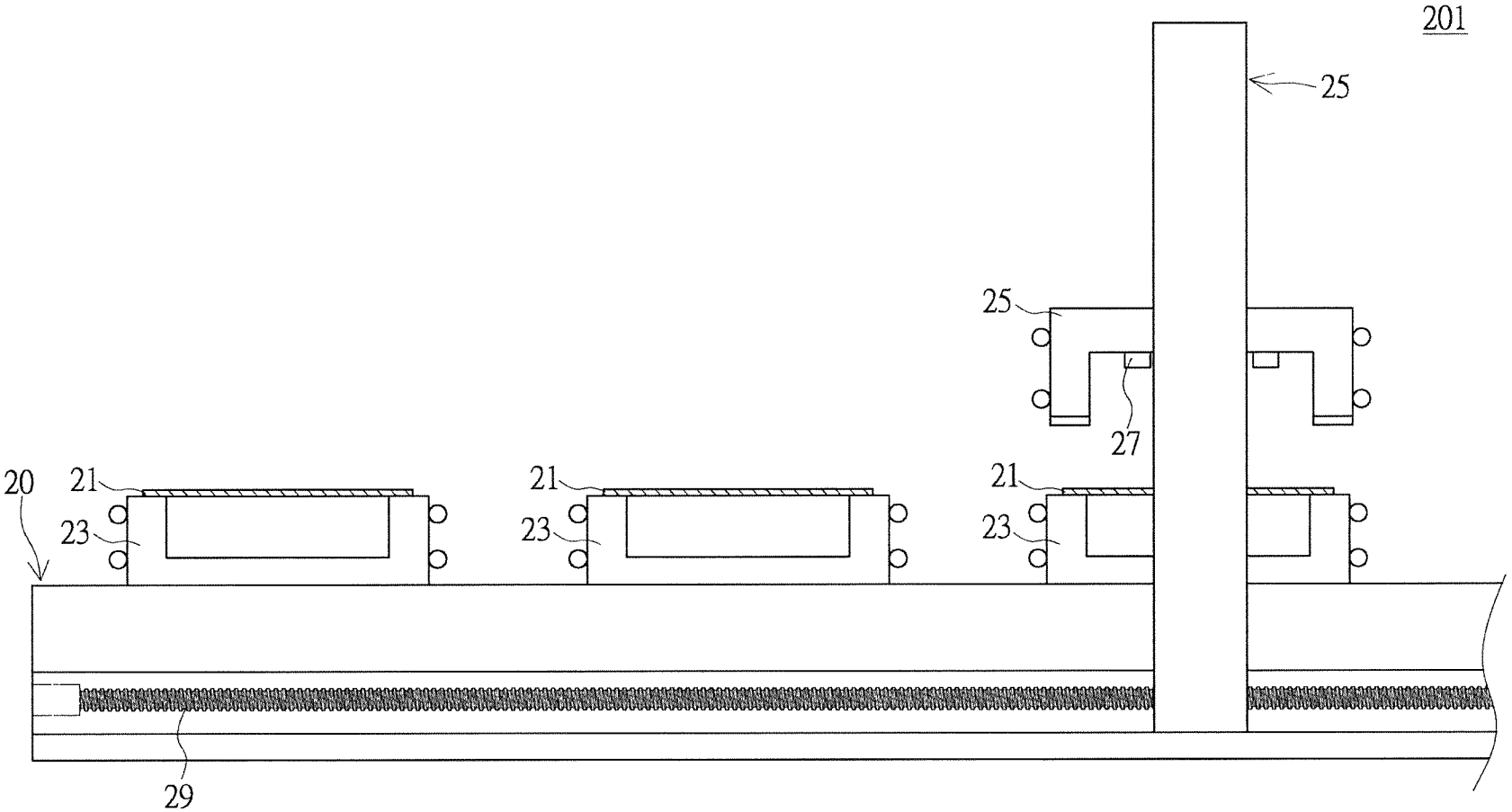
FIG. 9 is a schematic side view of a metal forming system with accelerated mass production according to further embodiment of the present invention.
Figure 10:
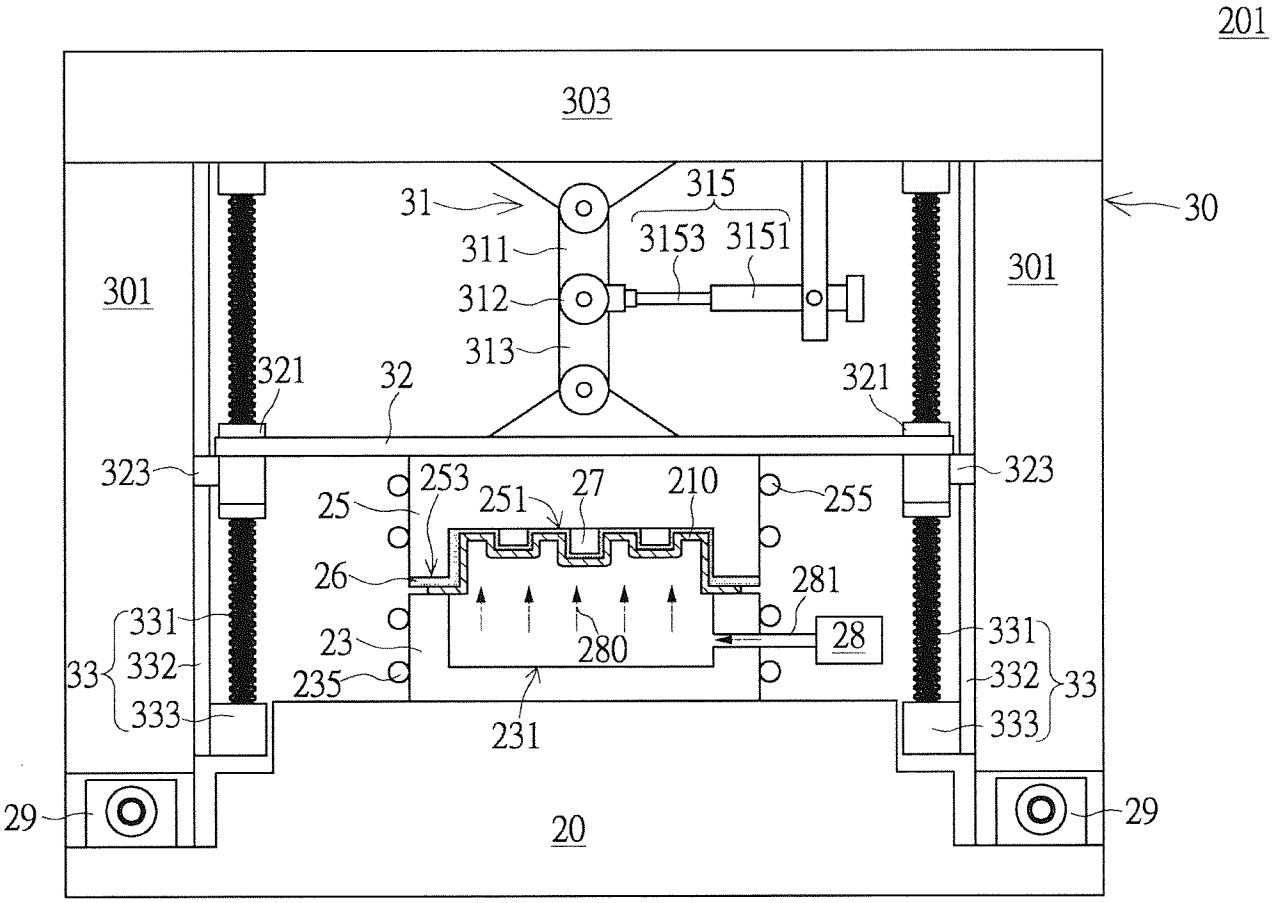
FIG. 10 is a schematic front view illustrating a mold-closing state formed between the upper mold base and the lower mold base of the metal forming system with accelerated mass production according to further embodiment of the present invention.
Figure 11:
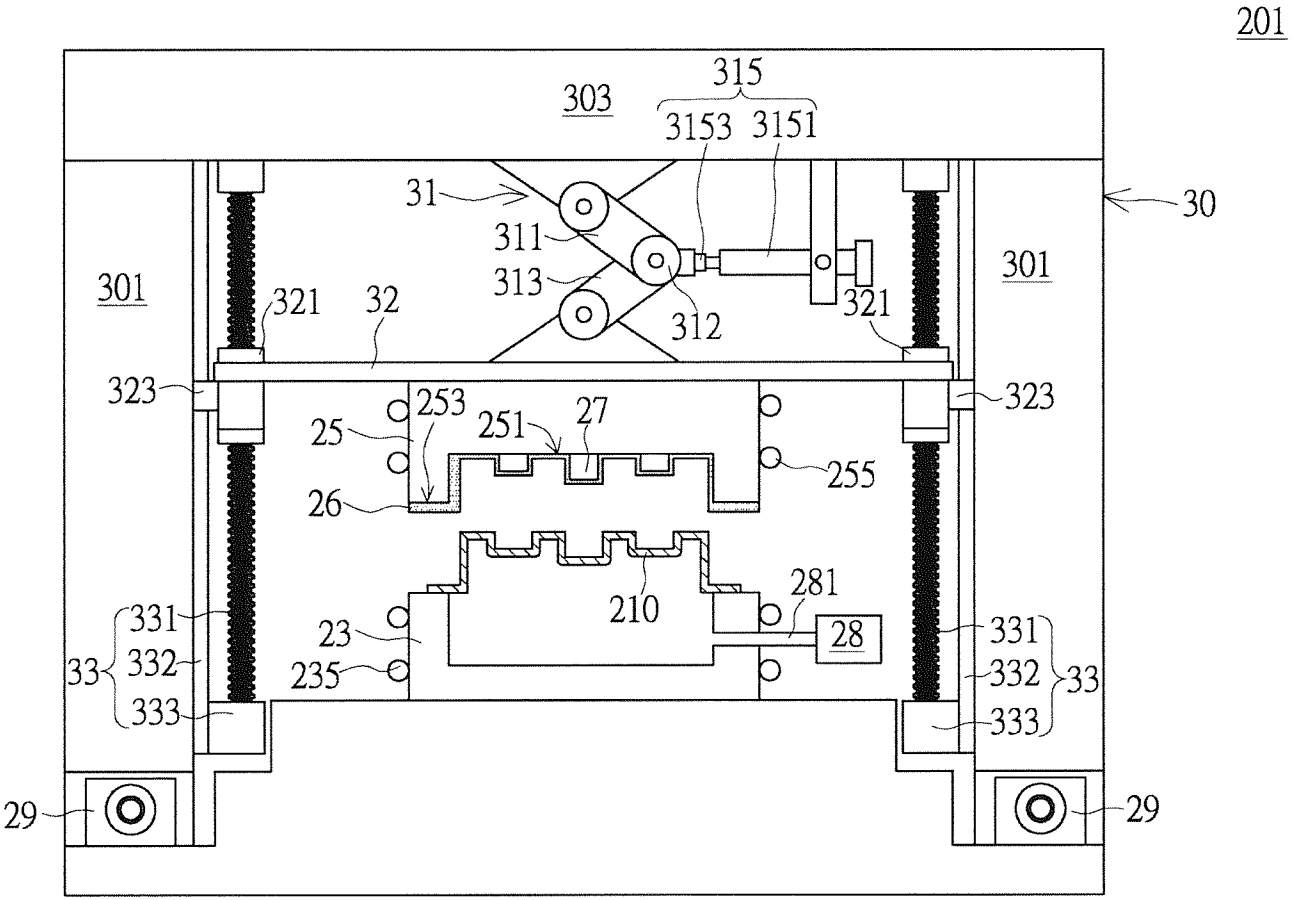
FIG. 11 is a schematic front view illustrating a mold-opening state formed between the upper mold base and the lower mold base of the metal forming system with accelerated mass production according to further embodiment of the present invention.

Referring to FIGS. 9, 10 and 11, there are shown a schematic side view of a metal forming system with accelerated mass production according to further embodiment, a schematic front view illustrating a mold-closing state formed between the upper mold base and the lower mold base of the metal forming system according to further embodiment, as well as a schematic front view illustrating a mold-opening state formed between the upper mold base and the lower mold base of the metal forming system according to further embodiment of the present invention, respectively. In the metal forming system 200 of the above embodiment, several forming molds (such as the lower mold bases 23 in the above embodiment, for example), each having the pattern layer 27, are provided on the platform 20, while one sealing mold (such as the upper mold base 25 in the above embodiment, for example) is provided on the gantry means 30. On the contrary, in the metal forming system 201 of the present embodiment, several sealing molds (such as the lower mold bases 23 in the present embodiment, for example) are provided on the platform 20, while one forming mold (such as the upper mold base 25 in the present embodiment, for example), having the pattern layer 27, is provided on the gantry means 30. Furthermore, in the present embodiment, the fluid passage 281 is also provided in the main body of the lower mold base 23 instead, while the pattern layer 27 is also provided on an inner surface 251 of the upper mold base 25 instead, accompanied with interchange of locations between the sealing mold and the forming mold.

Referring to FIG. 9, when the metal forming system 201 is desired to perform metal forming operation on the sheet metal 21, the gantry means 30 may be allowed to displace laterally toward a location above a lower mold base 23 which is predetermined to operate.

Subsequently, as illustrated in FIG. 10, the toggle unit 31 and/or the longitudinally displacing unit 33 may be operated to drive the upper mold base 25 downward so as to approach to the lower mold base 23, in such a way that a mold-closing state is formed between the upper mold base 25 and the lower mold base 23. After the mold-closing state between the upper mold base 25 and the lower mold base 23 is formed, the high-pressure fluid 280 may be provided by the fluid supplier 28, and then injected into the inner chamber of the lower mold base 23 through the fluid passage 281. The high-pressure fluid 280 is allowed to apply fluid pressure to the sheet metal 21 having been softened by heating, in such a way that the sheet metal 21 is adhered to the inner surface 251 of the upper mold base 25 under the action of fluid pressure to be formed into a metal formed part 210 accordingly.

Afterwards, as illustrated in FIG. 11, the toggle unit 31 and/or the longitudinally displacing unit 33 may be operated again to drive the upper mold base 25 upward so as to separate from the lower mold base 23, in such a way that the mold-opening state is formed between the upper mold base 25 and the lower mold base 23. After the mold-opening state between the upper mold base 25 and the lower mold base 23 is formed, the gantry means 30 is driven by the metal forming system 201 again to perform displacement toward a location above another lower mold base 23 which is predetermined to operate next. Then, the metal forming operation on the next sheet metal 21 is proceeded.

In this embodiment, the anti-sticking coating 26 is painted on the inner surface 251 and the joint face 253 of the upper mold base 25. The metal formed part 210 in high-temperature state may be not stuck to the surface 251/253 of the upper mold base 25 owing to an anti-sticking effect of the painted anti-sticking coating 26, in such a way that the upper mold base 25 may be then opened with respect to the lower mold base 23 immediately without the need to wait a cooling process. After the mold is opened, the metal formed part 210 formed in the upper mold base 25 may be demolded from the upper mold base 25 and then allowed to fall onto the lower mold base 23. Afterwards, the lower mold base 23 and the metal formed part 210 borne thereon may be driven away from the platform 20 to be successively subject to subsequent temper in the last stage of production.

Furthermore, the price of the forming mold having the pattern layer 27 is often far higher than that of the sealing mold. Therefore, in the metal forming system 201 of the present embodiment, the high-priced forming mold (such as the upper mold base 25 in the present embodiment, for example) is provided on the gantry means 30, and then allowed to perform metal forming operation with respect to each of the sealing molds (such as lower mold base 23 in the present embodiment, for example) provided on the platform 20 in succession via the displacement of the gantry means 30. In this way, the number of arranged forming molds may be decreased effectively, so as to reduce the cost for the establishment of the system 201.

To sum up, the lateral displacement of the gantry means 30 above the platform 20 is used in the metal forming system 200/201 of the present invention to perform metal forming operation. Thus, not only the metal formed parts 210 may be manufactured successfully, but also the manufacturing lead time of one individual metal formed part 210 may be reduced to perform metal forming operation effectively.

The foregoing description is merely one embodiment of the present invention and not considered as restrictive. All equivalent variations and modifications in shape, structure, feature, and spirit in accordance with the appended claims may be made without in any way from the scope of the invention.

The invention claimed is:

1. A metal forming system with accelerated mass production, comprising:

a platform comprising two sides, wherein each side of said platform is provided with a laterally displacing unit, respectively;

a gantry means, mounted above said platform, comprising at least two uprights and a top base, said top base being provided on a top end of each of said uprights, while a bottom end of each of said uprights being fixed on said corresponding laterally displacing unit, respectively, said gantry means capable of being driven by said laterally displacing unit to perform lateral displacement on said platform;

a plurality of lower mold bases provided at a center of said platform;

at least one upper mold base, a sheet metal being provided between said upper mold base and each of said lower mold bases; and a toggle unit, provided between said top base of said gantry means and said upper mold base, used for adjusting a longitudinal position of said upper mold base so as to change a distance between said upper mold base and said lower mold base, resulting in determining whether a mold-closing state or a mold-opening state is formed between said upper mold base and said lower mold base, a metal forming operation being performed on said sheet metal between said upper mold base and said lower mold base so as to manufacture a metal formed part when said mold-closing state is presented between said upper mold base and said lower mold base.

2. The metal forming system according to claim 1, wherein said toggle unit comprises a first link, a second link and a pneumatic cylinder, one end of said first link is pivoted on a bottom surface of said top base, while one end of said second link is pivoted on a top surface of said upper mold base, said other end of said first link is pivoted to that of said second link together to form a pivot, said pneumatic cylinder being connected to said pivot so as to drive said toggle unit to generate toggle motion, resulting in the adjustment of longitudinal position of said upper mold base.

3. The metal forming system according to claim 1, wherein each of said two uprights is individually provided at inner side thereof with a longitudinally displacing unit, a movable board being further provided between said toggle unit and said upper mold base, said longitudinally displacing unit comprising a screw rod and a driving part, said movable board being provided at each of two sides thereof with a threaded hole, respectively, each threaded hole being allowed to wrap around said corresponding screw rod, respectively, said driving part driving said screw rod to turn so as to drive said movable board to move up and down, thus further adjusting the longitudinal position of said upper mold base.

4. The metal forming system according to claim 1, wherein said upper mold base comprises an inner surface and at least one joint face to be joined to said sheet metal, an anti-sticking coating being provided on said inner surface and/or said joint face of said upper mold base.

5. The metal forming system according to claim 1, wherein said lower mold base is provided on an inner surface thereof with a pattern layer.

6. The metal forming system according to claim 1, wherein said upper mold base is a sealing mold, while said lower mold base is a forming mold, said upper mold base being provided with a fluid passage, a high-pressure fluid provided by a fluid supplier is injected into an inner chamber of said upper mold base through said fluid passage of said upper mold base, in such a way that said sheet metal is adhered to an inner surface of said lower mold base under the action of fluid pressure of said high-pressure fluid, thus manufacturing said metal formed part.

7. The metal forming system according to claim 1, wherein said upper mold base is provided on an inner surface thereof with a pattern layer.

8. The metal forming system according to claim 1, wherein said upper mold base is a forming mold, while said lower mold base is a sealing mold, said lower mold base being provided with a fluid passage, a high-pressure fluid provided by a fluid supplier is injected into an inner chamber of said lower mold base through said fluid passage of said upper mold base, in such a way that said sheet metal is adhered to an inner surface of said upper mold base under the action of fluid pressure of said high-pressure fluid, thus manufacturing said metal formed part.

9. A metal forming system with accelerated mass production, comprising:

a platform comprising two sides, each side of said platform provided with a laterally displacing unit, respectively;

a gantry means, mounted above said platform, comprising at least two uprights and a top base, said top base being provided on a top end of each of said uprights, while a bottom end of each of said uprights being fixed on said corresponding laterally displacing unit, respectively, said gantry means capable of being driven by said laterally displacing unit to perform lateral displacement on said platform;

a pair of longitudinally displacing units, each provided at inner side of corresponding one of said uprights, respectively;

a plurality of lower mold bases provided at a center of said platform; and at least one upper mold base, a sheet metal being provided between said upper mold base and each of said lower mold bases, said upper mold base being mounted to said longitudinally displacing units via a movable board, said longitudinally displacing units being used for adjusting a longitudinal position of said upper mold base so as to change a distance between said upper mold base and said lower mold base, resulting in determining whether a mold-closing state or a mold-opening state is formed between said upper mold base and said lower mold base, a metal forming operation being performed on said sheet metal between said upper mold base and said lower mold base so as to manufacture a metal formed part when said mold-closing state is presented between said upper mold base and said lower mold base.

10. The metal forming system according to claim 9, wherein said longitudinally displacing unit comprises a screw rod and a driving part, said movable board being provided at each of two sides thereof with a threaded hole, respectively, each threaded hole being allowed to wrap around said screw rod, said driving part driving said screw rod to turn so as to drive said movable board to move up and down, thus further adjusting the longitudinal position of said upper mold base.

* * * * *